United States Patent [19]

Thulman et al.

[11] 4,404,953

[45] Sep. 20, 1983

[54] STOVE FOR BURNING COMBUSTIBLE SOLID FUELS

[76] Inventors: Robert D. Thulman, 10309 Wilde Lk. Ter., Columbia, Md. 21044; Alve J. Erickson, 17 Pleasant St., Milford, N.H. 03055

[21] Appl. No.: 260,092

[22] Filed: May 4, 1981

[51] Int. Cl.[3] ..... F24C 1/14

[52] U.S. Cl. ..... 126/77; 126/64; 126/83; 126/193

[58] Field of Search ..... 126/60, 61, 64, 77, 126/66, 83, 76, 75, 200, 193, 198

[56] References Cited

U.S. PATENT DOCUMENTS

| | | | |
|---|---|---|---|
| 4,136,662 | 1/1979 | Willson | 126/200 |
| 4,157,704 | 6/1979 | Zimmer | 126/77 |
| 4,210,119 | 7/1980 | Kincaid | 126/200 |
| 4,213,446 | 7/1980 | Stookey et al. | 126/200 |
| 4,214,569 | 7/1980 | Heine | 126/193 |
| 4,240,403 | 12/1980 | Bader | 126/193 |
| 4,343,289 | 8/1982 | Zimmerman | 126/77 |

FOREIGN PATENT DOCUMENTS

| | | | |
|---|---|---|---|
| 1222874 | 1/1960 | France | 126/77 |

*Primary Examiner*—James C. Yeung
*Attorney, Agent, or Firm*—Schwartz, Jeffery, Schwaab, Mack, Blumenthal & Koch

[57] ABSTRACT

A stove (10) for burning combustible solid fuels (64) comprising an enclosed firebox (16), a baffle (54) dividing the firebox into a lower combustion chamber (18) and an upper chamber (20) spaced from the front wall (36,46) of the firebox to permit combustion gases to flow from the combustion chamber into the upper chamber, a door (24) for facilitating introduction of solid fuel into the combustion chamber, an outlet flue (48) communicating with the upper chamber for withdrawing combustion gases from the firebox, a viewing window (38) in a wall of the firebox for enabling the fire to be viewed without opening the door of the firebox, an air inlet (72) for admitting a flow of air into the firebox and means (84) for splitting a flow of air admitted through the air inlet into first and second portions and for directing the first portion toward the bottom of the combustion chamber and the second portion into a stream of hot combustion gases passing from the combustion chamber to the upper chamber; a shroud (50) spaced from the back wall (60) of the firebox for preventing radiant heat transfer rearwardly of the stove and for directing a flow of fan forced air across the hot top and side walls (42,44,48) of the firebox to increase convective heat transfer and an air injection conduit (104) communicating between the space between the shroud and the back wall of the firebox and the bottom of the combustion chamber for introducing fan forced additional combustion air into the combustion chamber.

40 Claims, 3 Drawing Figures

STOVE FOR BURNING COMBUSTIBLE SOLID FUELS

BACKGROUND OF THE INVENTION

Restrictions on the availability and increases in the price of petroleum derived fuels and electricity have prompted renewed interest in stoves for burning combustible solid fuels such as wood or coal. So called air-tight stoves which when properly banked will maintain a fire for 8 to 12 hours or more without charging additional fuel have proved objects of particular interest. Known stoves, however, are associated with many shortcomings.

Conventional wood and coal stoves are not very efficient space heaters. Only a fraction of the heat released upon combustion of the fuel is successfully transfered to the room in which the stove is located. Undesirably large proportions of the heat escape with the combustion gases from the stove up the flue.

Wood and coal stoves transfer heat in two ways, by radiation and by convection. Stoves designed for maximum radiant heat transfer usually have a single shell which is heated to a high temperature to radiate heat into the room, but such stoves provide limited convective heat transfer. Stoves developed for efficient convective heat transfer typically are designed with inner and outershells and a blower to force convection air through the space between the shells. The outer shell, however inhibits radiant heat transfer.

The maximum heat output obtainable from most stoves is limited by the natural draft which draws combustion air into the stove, by the size of the stove itself, and by the maximum permissible surface temperature of the stove. Stove surface temperatures can reach 1300 degrees F. or more, but for safe operation should be maintained at sustained temperatures of not more than about 900 degrees F. Because of the high temperatures which the surface of the stove may reach and the large amount of radiant heat transferred from such hot surfaces, stoves typically must be installed some distance away from walls and furniture which could be overheated and ignited. Such installation requirements consume undesirably large amounts of room space.

Stoves provided with electrically driven blower systems to carry heat away from the stove may overheat if the blower is turned off or rendered inoperative by a power outage.

Although substantially all stoves are provided with a damper for regulating the amount of combustion air admitted to the stove, such systems provide only rough control of the heat output of the stove, and in many cases it is difficult to rapidly increase or reduce the heat output of the stove.

Some stoves are provided with windows to enable users of the stove to view a fire within the stove without opening the stove door. An esthetically pleasing view of the fire may still not be obtained, however, because the view of the fire may be blocked by non-burning fuel. Accumulations of soot and dirt on the interior of the window may also obstruct the view of the fire.

In view of the many shortcomings of known wood stoves, there remains a need for an improved stove for burning combustible solid fuels.

SUMMARY OF THE INVENTION

Accordingly, it is an object of the present invention to provide an improved stove for burning combustible solid fuels.

It is also an object of the present invention to provide a stove for burning combustible solid fuels which has a high operating efficiency.

A further object of the present invention is to provide an air-tight stove for burning combustible solid fuels which will maintain a properly banked fire overnight or longer without requiring addition of more fuel to the fire.

Another object of the present invention is to provide a stove for burning combustible solid fuels which will transfer heat effectively both by radiation and by convection.

Yet another object of the present invention is to provide a stove for burning combustible solid fuels which will provide a very high heat output for its size.

A further object of the present invention is to provide a stove for burning combustible solid fuels wherein the exterior surface temperature of the stove is maintained at a safe, comparatively low level.

Still another object of the present invention is to provide a stove for burning combustible solid fuels which can be safely installed a short distance from a combustible wall.

Another object of the present invention is to provide a stove euipped with a blower system for burning combustible solid fuels which has little or no tendency to overheat if the blower is rendered inoperative.

An additional object of the present invention is to provide a stove for burning combustible solid fuels from which the heat output may be readily controlled.

It is also an object of the present invention to provide a stove for burning combustible solid fuels in which a fire will be readily visible without opening the stove.

A still further object of the present invention is to provide a stove for burning combustible solid fuels having a window on which accumulations of soot and dirt are prevented.

These and other objects of the invention are achieved by providing a stove for burning combustible solid fuels comprising an enclosed firebox, means for dividing said firebox into a lower combustion chamber and an upper chamber and for permitting gases from the combustion chamber to flow into the upper chamber, means for facilitating introduction of solid fuel into the combustion chamber, outlet means communicating with the upper chamber for withdrawing combustion gases from the firebox, air inlet means through a wall of the firebox for admitting a flow of air into the firebox and means for splitting a flow of air admitted into the firebox through the air inlet means into first and second portions and for directing the first portion toward the bottom of the combustion chamber and the second portion toward the upper chamber.

In preferred aspects of the invention the dividing means comprises a baffle extending generally horizontally across the firebox from the rear wall to a point spaced from the front wall thereof and thence generally upwardly parallel to the front wall of the firebox to a point spaced from the top thereof; the front and side walls of the upper chamber of the firebox are inclined approximately 45 degrees from horizontal; a window is provided in the front wall of the combustion chamber, the air inlet means comprises a horizontally elongated opening through the combustion chamber front wall adjacent the top of the window; a hooded damper is provided for regulating the flow of air through the air inlet opening; the splitter means comprises a curved deflector plate or baffle having a substantially S-shaped vertical cross section disposed adjacent the air inlet opening with the outer surface of the upper curve of the S-shaped deflector forming a restricted venturi throat with the front wall of the combustion chamber above the air inlet opening, the upper extremity of the S-shaped deflector plate partially closing off the space between the front wall of the combustion chamber and the dividing baffle, and the lower extremity of the S-shaped deflector plate directing the first air portion downwardly across the firebox window toward the bottom of the combustion chamber; a shroud is provided spaced from the back wall of the firebox projecting vertically beyond the top of the firebox and laterally beyond the side walls of the firebox and terminating in forwardly projecting flanges along the top and side margins thereof; fan means are provided for forcing air between said shroud and the back wall of the firebox and thence over the top and side walls of the firebox; an air injection conduit is provided extending from the space between the shroud and the back wall of the firebox across the firebox adjacent the dividing baffle and downwardly along the front wall of the combustion chamber; and a deflector is provided for directing a stream of air discharged from the air injection conduit toward the hearth at the bottom of the combustion chamber.

BRIEF DESCRIPTION OF THE DRAWINGS

The invention will be explained in further detail with reference to the accompanying drawings wherein.

DETAILED DESCRIPTION OF PREFERRED EMBODIMENTS

Figure 1:
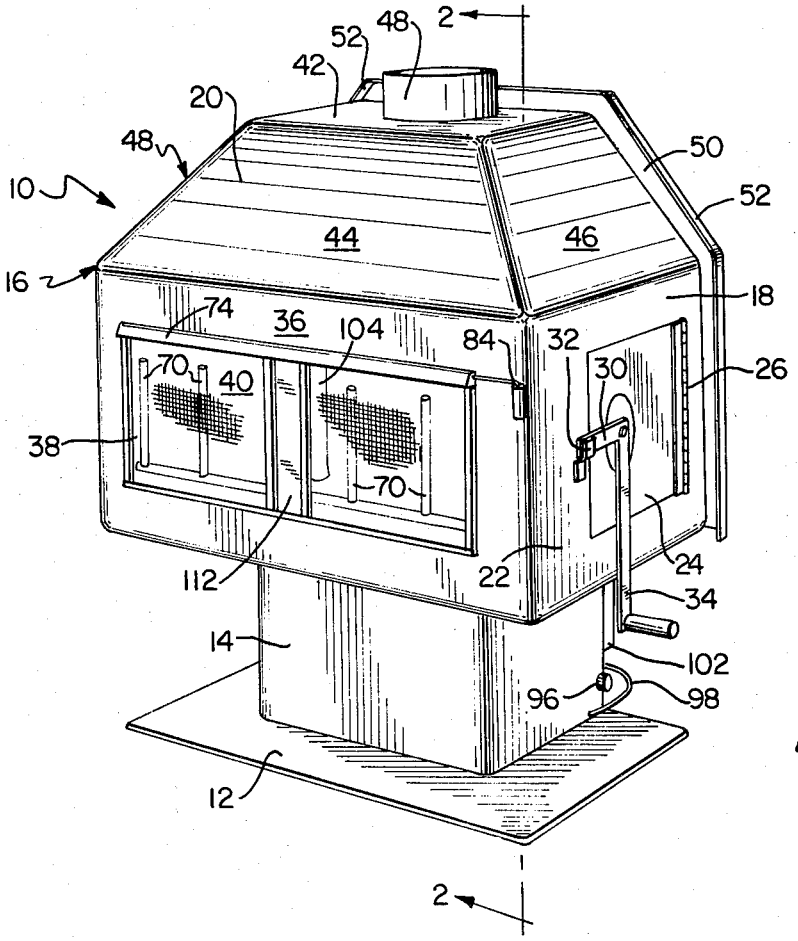
FIG. 1 is a perspective view of a stove according the present invention.

FIG. 1 depicts a stove according to the present invention generally designated by reference numeral 10. Stove 10 comprises a flat base 12 upon which a hollow pedestal 14 is secured. On top of pedestal 14 is a single wall firebox generally designated by reference numeral 16 comprising a lower combustion chamber portion 18 and an upper chamber portion 20. Formed in one of the combustion chamber side walls 22 is a door 24 for facilitating introduction of combustible solid fuel into the combustion chamber of the firebox. Door 24 is mounted on a hinge 26 so as to be openable and closable. A latch mechanism comprising a rotatable bar secured to door 24 and a receiving bracket 32 secured to wall 22 is provided to hold the door in the closed position. An elongated handle 34 is secured to bar 30 such that the handle and the bar make a right angle with each other, and the handle hangs generally downwardly when bar 30 is received in bracket 32. The force of gravity acting on handle 34 thus serves to hold the latch in the closed position. The door may be opened by manually lifting the handle upwardly and forwardly until bar 30 is released from bracket 32 and thereafter swinging the door laterally about hinge 26 to an open position. When closed, door 24 is substantially air-tight so that substantially all combustion air must enter the firebox through the specifically described air inlet means and/or air injection means described hereinafter.

In the front wall 36 of combustion chamber 18 there is a window 38 comprising a pane of substantially transparent, heat resistant glass 40 through which a fire in the firebox may be viewed without opening door 24. In the illustrated embodiment, window pane 40 is mounted substantially flush with combustion chamber front wall 36. For safety reasons, a screen may be provided over the outer face of window pane 40 if desired. Also, if it is desired to have open combustion within the firebox, window pane 40 may be removed from mounting brackets 41 and 43 and replaced by an appropriate screen.

The top wall 42 of the firebox is generally horizontal and is substantially smaller in area than the bottom of the firebox. Upper chamber 20 of the firebox has side and front wall portions 44 and 46 respectively which are inclined at an angle of approximately 45 degrees from vertical and connect the upper extremities of combustion chamber side and front wall 22 and 36 respectively to top wall 42.

In the illustrated embodiment a flue outlet 48 is provided through top wall 42 for withdrawing combustion gases from the upper chamber of the firebox. It is understood, however, that the flue need not be located in the top wall of the firebox. Fox example, the flue opening could also be located in the back wall 60 of the firebox to accomodate low fireplace openings, if desired.

A shroud 50 is disposed behind the firebox in spaced relation to back wall 60 thereof. Shroud 50 projects laterally a short distance beyond the side walls (22 and 44) of the firebox and also a short distance above top wall 42 of the firebox and terminates at its periphery in a continuous, forwardly projecting flange 52. Flange 52 serves to direct air from between the back wall of the firebox and the shroud forwardly across the top and side walls of the firebox as will be described in greater detail hereinafter.

Figure 2:
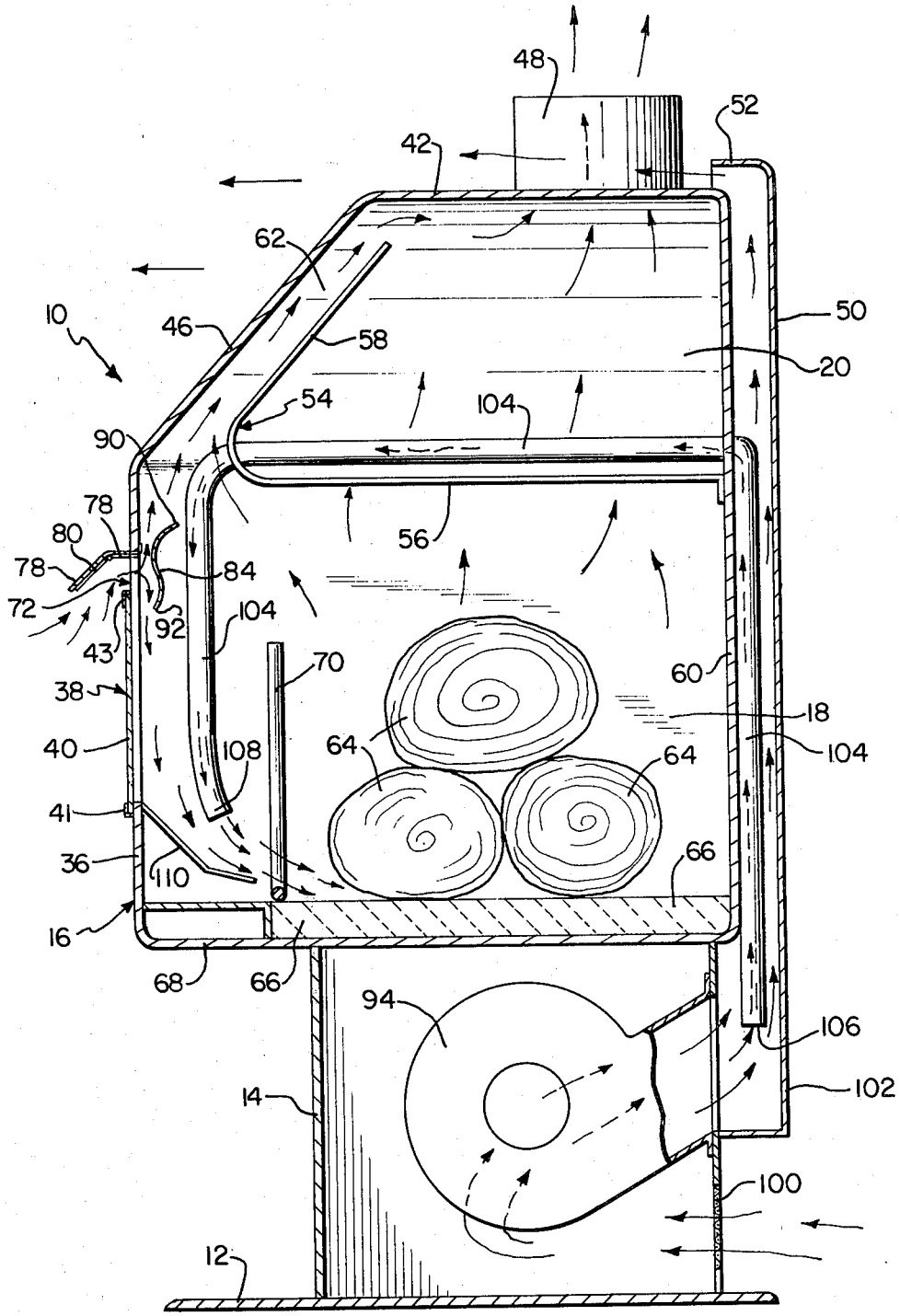
FIG. 2 is a sectional elevation of the stove of FIG. 1 taken along line 2—2.

Turning now to FIG. 2, it can be seen that combustion chamber 18 is separated from upper chamber 20 by a baffle 54 comprising a generally horizontal portion 56 extending from the back wall 60 of firebox 16 substantially across the firebox to a point spaced from the front wall 36 of the combustion chamber and a generally upwardly projecting portion 58 extending from the forward extremity of baffle portion 56 generally parallel to upper chamber front wall 46 to a point spaced from firebox top wall 42. Divider baffle portion 58 and upper chamber front wall 46 thus define a passageway 62 through which hot combustion gases from combustion chamber 18 may pass to upper chamber 20. Divider baffle 54 serves to prevent hot combustion gases from combustion chamber 18 from passing directly to flue 48. Instead, most of the hot combustion gases are caused to circulate to the front of the stove and thenceupwardly along front wall 46 of upper chamber 20 and top wall 42 before exiting through flue 48 so that more of the heat from the gases will be released before the gases are withdrawn through the flue.

The sides of baffle portion 56 may be spaced slightly from the side walls of the firebox so that a minor portion, usually 25 percent or less, of the hot combustion gases may pass therearound and along upper chamber side walls 44 and 48. The spacing should be relatively small, however, so that the major portion of the hot combustion gases is constrained to traverse passageway 62.

Pieces of combustible solid fuel such as logs 74 are introduced into combustion chamber 18 for burning. A layer of ceramic firebrick 66 is disposed over the bottom wall 68 of firebox 16 to form a hearth for the stove. Optionally, the side and back walls of the combustion chamber may also be provided with a protective layer of ceramic material.

If desired, the fuel can be placed and burned directly on the hearth. Alternatively, grate means (not shown) may be provided in the combustion chamber for supporting the fuel above the hearth so that air may circulate underneath the fuel.

A protective grate comprising a series of spaced vertical bars 70 is provided at the front of the hearth to prevent the fuel from falling against window pane 40.

Figure 3:
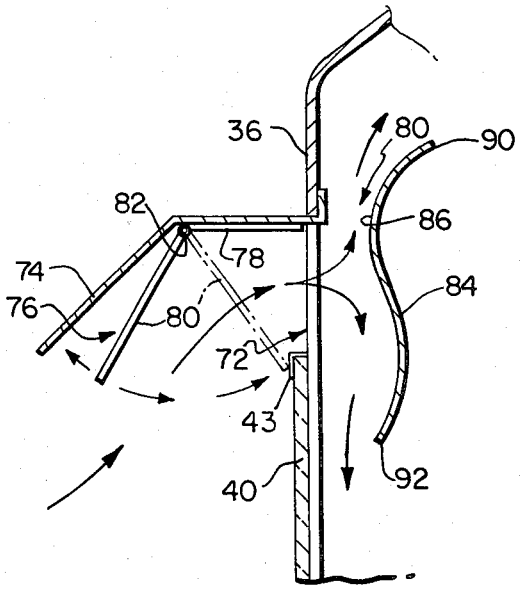
FIG. 3 is an enlarged detail view of the air inlet opening, the damper assembly and the venturi splitter baffle.

As seen more clearly in the enlarged detail view of FIG. 3, there is an air inlet opening 72 adjacent the top of combustion chamber front wall 36 extending along the top of window 38. Inlet 72 is covered by a hood 74 which shields the air inlet from direct view by a person standing in front of the stove. Secured to the underside of the hood 74 is a damper 76 comprising a pair of leaves 78 and 80 pivotally joined to each other by hinge 82. Leaf 78 is firmly secured to the underside of hood 74, and leaf 80 is rigidly secured to a damper control handle 84 which projects laterally from the hood in front of the stove. By manually adjusting the position of handle 84, damper leaf 80 may be moved from a fully open position adjacent hood 74, as shown in FIG. 2, to a fully closed position, as shown by broken lines in FIG. 3, in which leaf 80 extends between hood 74 and the top of window pane 40 to close off air inlet 72. Hinge 82 provides sufficient resistance to rotation that as shown in solid lines in FIG. 3, leaf 80 may also be disposed at any desired position intermediate the fully closed and fully open positions. In this fashion, it is possible to regulate the amount of air drawn into firebox 16 through air inlet 72.

Inside firebox 16 adjacent air inlet 72 there is provided a splitter baffle or plate 84 having a generally S-shaped vertical cross section. Splitter baffle 84 extends across the front of stove 10 for at least the entire length of air inlet opening 72 and is secured in spaced relation to front wall 36 of combustion chamber 18 by suitable bolts and spacers or brackets (omitted from the drawing for clarity). The outer surface 86 of the upper curve of the S-shaped splitter baffle forms a restricted venturi throat 88 with the front wall 36 of combustion chamber 18 above air inlet 72 through which a minor portion of the air drawn in through inlet 72 passes into passageway 62. The upper extremity 90 of splitter baffle 84 projects toward divider baffle 54 thereby partially closing off the entrance to passageway 62 and restricting the flow of hot combustion gases from combustion chamber 18 through passageway 62 into upper chamber 20. In general, the width of the space between the divider baffle 54 and extremity 90 of splitter baffle 84 should be less than the width of passageway 62. The lower extremity 92 of splitter plate 84 curves downwardly toward the inner surface of window pane 40 and serves to direct the major portion of the air drawn in through inlet 72 downwardly across the inside of window 38 in the front wall of combustion chamber 18 toward the bottom of the combustion chamber.

Air drawn into the firebox through air inlet 72 by the natural draft of flue 48 is divided into two portions by splitter baffle 84. The first and largest portion is directed downwardly across the inside surface of glass window pane 40 toward the bottom combustion chamber 18. Due to the configuration of the air inlet and the splitter baffle and the geometry of the window mounting, the downflowing air is distributed substantially uniformly across the entire length of the window pane throughout substantially its entire height. Passage of a uniformly distributed stream of clean room air over the inside surface of the glass pane keeps the glass clean and cool. It is thus possible to dispense with the unsightly window box common to most windowed stoves which protrudes into the room and takes up valuable space. The air is directed toward the base of the fire where it is needed to support combustion. The resulting flame pattern is very dramatic and nice looking. By directing the combustion air to the front of the fire, a tendency for the fire to burn from front to back in the stove is promoted. Consequently, the view of the fire through window 38 is not obscured by non-burning fuel, and the visual effect is significantly improved.

The second portion of the air entering through air inlet 72 is drawn through the restricted venturi throat 88 and is supplied to upper chamber 20 through passageway 62 with the combustion gases as secondary air.

At low and moderate firing levels, the upper extremity 90 of splitter baffle 84 does not exert any substantial restriction on the flow of combustion gases from combustion chamber 18 to upper chamber 20. At high firing levels and correspondingly high rates of combustion gas flow, the resistance to flow exerted by upper extremity 90 of splitter baffle 84 becomes significant and acts to limit the combustion rate and the flue gas temperatures.

Returning to FIG. 2 it can be seen that a blower or fan 94 is mounted in the interior of hollow pedestal 14. Desirably fan 94 will be a variable speed electric fan controlled by a rheostat 96 so that the fan speed may be varied from zero to a maximum value. An electric cord for supplying power to fan 94 is identified by reference numeral 98. Fan 94 draws air into hollow pedestal 14 through a grate 100 located at the bottom of the back wall of the pedestal and forces a stream of air through a duct 102 located at the back of pedestal 14 above grate 100 to the bottom of shroud 50. The stream of air then flows between shroud 50 and back wall 60 of firebox 16 to the periphery of the shroud where it is directed by flange 52 toward the front of the stove across the top and side walls thereof and into the room. No special deflectors are provided in the space between firebox back wall 60 and shroud 50 to deflect the stream of air toward the sides of the stove. Consequently, most of the air stream is directed across firebox top wall 42, upper chamber side wall 44 and the corresponding upper chamber side wall 48 on the other side of the stove. This increases the efficiency of the stove since these surfaces tend to be hotter than the vertical side walls of the combustion chamber. The air passing over the hot stove walls increases the convective heat transfer into the room while at the same time resulting in cooler stove surface temperatures.

A tubular air injection conduit 104 is provided communicating between the space between baffle 50 and firebox rear wall 60 and the bottom of combustion chamber 18. In the illustrated embodiment, the inlet end 106 of air injection conduit 104 is disposed in duct 102. The conduit extends upwardly along the back wall of the combustion chamber to a point adjacent divider baffle 54 and thence through upper chamber 20 from the back to the front of the stove adjacent horizontal baffle portion 56 and downwardly along the front of the stove to conduit outlet 108 adjacent hearth 66. A deflector baffle 110 is provided adjacent outlet 108 for directing a stream of air exiting from air injection conduit 104 toward the hearth at the bottom of the combustion chamber so that the air will be supplied at the base of the front of a fire burning on the hearth. Air passing through conduit 104 is preheated as it tranverses upper chamber 20 to further enhance the operation of the stove. If desired, a partition 112 may be provided in window 38 in front of air injection conduit 104 in order conceal the conduit from view by a person standing in front of the stove.

Additional combustion air is forced by fan 94 through air injection conduit 104 to a fire burning in the combustion chamber. The resulting "forge effect" substantially increases the rate of combustion and the heat output of the stove. Importantly a single common fan is used to force the flow of additional combustion air through air injection conduit 104 and the flow of convection air between shroud 50 and the firebox and over the top and side walls of the firebox. The two air flows are thus coupled to each other, and an increase of one can only be effected together with a corresponding increase of the other. Consequently, an increase in the rate of combustion brought about by forcing additional combustion air into the combustion chamber through conduit 104 will always be accompanied by an increase in convective heat transfer by air flowing over top and side walls of the stove whereby overheating of the stove will be prevented despite the increased release of heat therein. Similarly if the flow of convection air is interrupted by turning off fan 94 or as a result of a power outage, the flow of combustion air through air injection conduit 104 and consequently the rate of combustion of a fire in the stove will also be decreased so that the stove will not overheat.

The efficiency of the stove is demonstrated by the following tests.

TEST I

A stove constructed as described was tested in a water cooled calorimeter room by burning ¾ inch standard firebrands having a known heat of combustion of 8127 Btu per pound in the stove with the damper open and the fan on. The ambient temperature was 67° F. Barometric pressure was 29.45 inches of mercury. The air flow rate was approximately 37 cubic feet per minute. The wood consumption rate on an hourly basis was approximately 9.55 lb. per hour, yielding an hourly heat release of about 77,600 Btu per hour. The net heat output rate from the stove was determined by measuring the amount of cooling water required to maintain a substantially constant room temperature in the calorimeter room of 74° F. and was found to be about 51,190 Btu per hour. The average efficiency was computed to be approximately 66 percent.

TEST II

The procedure of Test I was repeated except the ambient temperature was 74° F.; the average air flow rate was approximately 39 cubic feet per minute; the calorimeter room temperature was maintained at 71° F., and the wood consumption rate on an hourly basis was approximately 8.2 pounds per hour for an average hourly heat release of 66,600 Btu per hour. The net heat output rate from the stove was found to be 45,300 Btu per hour for an average efficienty of 68 percent.

During the tests, the glass window in the front of the stove remained clean.

When the combustion efficiency of the stove of the present invention is compared to that of an ordinary air-tight stove, which typically amounts to only about 50 percent or less, it can be seen that the stove of the present invention exhibits truly remarkable combustion efficiencies. Because the flow of combustion air to a fire burning in the stove can be precisely regulated by proper adjustment of the damper and the fan speed control, it is possible to maintain a properly banked fire in the stove for 8 to 12 hours or more without charging additional fuel. Since the front, top and side walls of the firebox comprise only a single layer of material, efficient radiant heat transfer into the room is promoted. Simultaneously, efficient convective heat transfer is also promoted by the stream of fan forced air passing up the back wall of the firebox and across the hot top and side walls of the stove into the room. A high heat output compared to conventional air-tight stoves of comparable size is made possible by directing the combustion air to the base of the fire where it can be efficiently used and by enabling additional combustion air to be fan forced into the combustion chamber to achieve a "forge effect". At the same time, the exterior surface temperatures of the stove are reduced by the fan forced convection air passing over the surface of the stove. The shroud mounted behind the firebox inhibits radiant heat transfer rearwardly of the stove and enables the stove to be safely installed as close as 12 inches from a combustible wall. This results in very substantial space savings in a room compared to conventional air-tight stoves which for safety reasons ordinarily must be installed from 30 to 36 inches from a combustible wall. Because the flow of fan forced combustion air entering the combustion chamber is effectively coupled to the flow of fan forced convection air passing over the hot exterior surfaces of the stove, the rate of heat production in the stove is coupled to the rate of heat transfer from the stove, and overheating of the stove is prevented if the blower system is rendered inoperative. Very flexible and responsive regulation of the rate of combustion in the stove is made possible by the ability to adjust the combustion air supplied to this stove through the frontal air inlet and the air injection conduit. Consequently, the net heat output of the stove can be more quickly adjusted and more readily controlled by a user compared to conventional air-tight stoves. The stove of the invention also improves fire visibility by supplying combustion air to the base of the fire at the front of the stove so that the fire is caused to burn from front to back and by passing a stream of clean air over the inner surface of the stove window pane so that accumulations of soot and dirt on the inside of the window are prevented.

The foregoing description has been set forth merely as an illustrative example of the invention and is not intended to be limiting. Since modifications of the disclosed embodiments incorporating the substance and spirit of the invention may occur to persons skilled in the art, the scope of the invention is to be limited solely with respect to the appended claims.

We claim:

1. A stove for burning combustible solid fuels comprising:

an enclosed firebox;

baffle means for dividing said firebox into a lower combustion chamber and an upper chamber and for permitting gases from said combustion chamber to flow into said upper chamber;

means for facilitating introduction of combustible solid fuel into said combustion chamber;

outlet means communicating with said upper chamber for withdrawing combustion gases from said firebox;

air inlet means through a wall of said firebox for admitting a flow of air into the firebox;

means for splitting a flow of air admitted into said firebox through said air inlet means into first and second portions and for directing said first portion of air toward the bottom of said combustion chamber and said second portion of air toward said upper chamber;

said baffle comprising a generally horizontal portion extending from the back wall of the firebox to a point spaced from the front wall of the firebox and an upwardly projecting portion extending from said horizontal portion generally parallel to said front wall to a point spaced from the top of said firebox; and said upwardly projecting portion and said front wall defining a passageway through which gases may pass from said combustion chamber to said upper chamber.

2. A stove according to claim 1, further comprising grate means in said combustion chamber for supporting solid fuel above the hearth in said combustion chamber whereby air may circulate underneath said fuel.

3. Apparatus according to claim 1, wherein said generally horizontal baffle portion is spaced from the side walls of said firebox, whereby a portion of the gases from said combustion chamber may pass from said combustion chamber to said upper chamber without going through said passageway.

4. A stove according to claim 1, wherein said firebox comprises a generally flat hearth, generally vertical combustion chamber front, back and side wall portions extending upwardly from the periphery of said hearth, a generally horizontal top wall having a substantially smaller area than said hearth, a generally vertical upper chamber back wall substantially coplanar with said combustion chamber back wall portion and receding upper chamber front and side walls extending from the tops of the respective combustion chamber front and side wall portions to said horizontal top wall.

5. A stove according to claim 4, wherein said upper chamber front and side walls are inclined approximately 45 degrees from vertical.

6. A stove according to claim 1, wherein said outlet means comprises a flue communicating with said upper chamber through the top wall thereof.

7. A stove according to claim 1, wherein said outlet means comprises a flue communicating with said upper chamber through the rear wall thereof.

8. A stove according to claim 1, further comprising damper means for regulating the flow of air through said air inlet means into the firebox.

9. A stove according to claim 8, further comprising hood means over said damper means.

10. A stove according to claim 1, wherein said air inlet means comprises a horizontally elongated opening adjacent the top of the combustion chamber front wall portion.

11. A stove according to claim 1, wherein said firebox comprises a single wall enclosure.

12. A stove according to claim 1, wherein said first portion of air is substantially larger than said second portion of air.

13. A stove according to claim 1, further comprising window means in the front wall of said combustion chamber.

14. A stove according to claim 13, wherein said window means comprise at least one of substantially transparent, heat-resistant glass for facilitating viewing of a fire in said firebox.

15. A stove according to claim 14, wherein said air inlet means is disposed adjacent the top of said window means.

16. A stove according to claim 15, wherein said splitter means directs said first portion of air downwardly across said window means, whereby soot and dirt are prevented from accumulating on the inside of said window means.

17. A stove according to claim 14, further comprising screen means removably positionable over the exterior of said window means.

18. A stove according to claim 14 further comprising grate means in said firebox adjacent said window means for preventing solid fuel in said combustion chamber from falling against said window means.

19. A stove according to claim 1, further comprising pedestal means for supporting said firebox in an elevated position.

20. A stove according to claim 9, further comprising shroud means spaced from the back wall of the firebox for inhibiting radiant heat transfer rearwardly of said stove.

21. A stove according to claim 20, further comprising forwardly projecting flange means along the top and side margins of said shroud means.

22. A stove according to claim 21, further comprising fan means for forcing a stream of air between said shroud means and the back wall of said firebox and thence over the top and side walls of said firebox.

23. A stove according to claim 22, wherein said fan means comprises a variable speed electric fan.

24. A stove according to claim 22, wherein said fan means is mounted in said pedestal means.

25. A stove according to claim 1, wherein said firebox is provded with a ceramic lining.

26. A stove according to claim 25, wherein said ceramic lining comprises a layer of firebrick at the bottom of the combustion chamber.

27. A stove according to claim 1, wherein said splitter means comprises a baffle adjacent said air inlet means.

28. A stove according to claim 27, wherein said baffle comprises a curved splitter plate having a substantially S-shaped vertical cross section.

29. A stove according to claim 28, wherein the lower extremity of said S-shaped splitter plate directs said first air portion downwardly across the front wall of said combustion chamber.

30. A stove according to claim 1, wherein said fuel introduction facilitating means comprises an openable and closeable, substantially air-tight door through a wall of the combustion chamber.

31. Apparatus according to claim 30, wherein said door means comprises a rotatable latch mechanism having an elongated handle which extends downwardly when said latch is in a closed and locked position, whereby the gravitational force acting upon said elongated handle urges said latch toward said closed and locked position.

32. A stove according to claim 30, wherein said door is formed in a side wall of the combustion chamber.

33. A stove for burning combustible solid fuels comprising:

an enclosed firebox;

means for dividing said firebox into a lower combustion chamber and an upper chamber and for permitting gases from said combustion chamber to flow into said upper chamber;

means for facilitating introduction of combustible solid fuel into said combustion chamber;

outlet means communicating with said upper chamber for withdrawing combustion gases from said firebox;

air inlet means through a wall of said firebox for admitting a flow of air into the firebox;

means for splitting a flow of air admitted into said firebox through said air inlet means into first and second portions and for directing said first portion of air toward the bottom of said combustion chamber and said second portion of air toward said upper chamber;

pedestal means for supporting said firebox in an elevated position;

shroud means spaced from the back wall of the firebox for inhibiting radiant heat transfer rearwardly of said stove;

forwardly projecting flange means along the top and side margins of said shroud means;

fan means for forcing a stream of air between said shroud means and the back wall of said firebox and thence over the top and side walls of said firebox; and air injection means communicating between the space between said shroud means and the back wall of said firebox and the bottom of the combustion chamber through which combustion air may be delivered to a fire burning in said combustion chamber.

34. A stove according to claim 33, wherein said injection means is a conduit leading from the space between said shroud and the back wall of the firebox to the bottom of the combustion chamber.

35. A stove according to claim 34, wherein said injection means traverses a high temperature area of said firebox, whereby air passing through said injection means may be preheated before being discharaged at the bottom of said combustion chamber.

36. A stove according to claim 35, wherein said injection means extends adjacent said dividing means from the back of said firebox to the front of said firebox and thence downwardly along the front wall of said combustion chamber toward the hearth.

37. A stove according to claim 36, further comprising deflector means for directing a stream of air discharging from said injection means toward the hearth at the bottom of said combustion chamber.

38. A stove according to claim 36, wherein said injection means extends through said upper chamber adjacent said baffle and thence downwardly along the front of said stove to a discharge point adjacent the hearth.

39. A stove for burning combustible solid fuels comprising:

an enclosed firebox;

means for dividing said firebox into a lower combustion chamber and an upper chamber and for permitting gases from said combustion chamber to flow into said upper chamber;

means for facilitating introduction of combustible solid fuel into said combustion chamber;

outlet means communicating with said upper chamber for withdrawing combustion gases from said firebox;

air inlet means through a wall of said firebox for admitting a flow of air into the firebox;

means for splitting a flow of air admitted into said firebox through said air inlet means into first and second portions and for directing said first portion of air toward the bottom of said combustion chamber and said second portion of air toward said upper chamber;

said splitting means comprising a baffle adjacent said air inlet means;

said baffle comprising a curved splitter plate having a substantially S-shaped vertical cross section, and the outer surface of the upper curve of said S-shaped splitter plate forming a restricted venturi throat with the front wall of said combustion chamber above said air inlet means.

40. A stove for burning combustible solid fuels comprising:

an enclosed firebox;

means for dividing said firebox into a lower combustion chamber and an upper chamber and for permitting gases from said combustion chamber to flow into said upper chamber;

means for facilitating introduction of combustible solid fuel into said combustion chamber;

outlet means communicating with said upper chamber for withdrawing combustion gases from said firebox;

air inlet means through a wall of said firebox for admitting a flow of air into the firebox;

means for splitting a flow of air admitted into said firebox through said air inlet means into first and second portions and for directing said first portion of air toward the bottom of said combustion chamber and said second portion of air toward said upper chamber;

said splitting means comprising a baffle adjacent said air inlet means;

said baffle comprises a curved splitter plate having a substantially S-shaped vertical cross section, the upper extremity of said S-shaped splitter plate partially closing off the space between the front wall of the combustion chamber and the dividing means whereby the cross sectional area of the opening from the combustion chamber to the passageway between the upwardly projecting portion of said dividing means and the front wall of said upper chamber is less than the cross sectional area of said passageway.

* * * * *